US006964593B1

(12) United States Patent
Stevens

(10) Patent No.: US 6,964,593 B1
(45) Date of Patent: Nov. 15, 2005

(54) STUMP-CUTTING TOY ASSEMBLY

(76) Inventor: Geoffrey L. Stevens, 11 Beach La., Lakewood, WA (US) 98498

( * ) Notice: Subject to any disclaimer, the term of this patent is extended or adjusted under 35 U.S.C. 154(b) by 0 days.

(21) Appl. No.: 10/959,878

(22) Filed: Oct. 7, 2004

(51) Int. Cl.[7] ..... A63H 33/00
(52) U.S. Cl. ..... 446/4; 446/144; 434/393
(58) Field of Search ..... 446/1, 4, 85, 86, 446/120, 121, 124, 144; 434/258, 393; 144/195.8, 144/195.7

(56) References Cited

U.S. PATENT DOCUMENTS 2,955,381 A * 10/1960 Joslyn ..... 446/4
4,755,141 A * 7/1988 Nakai ..... 434/258
4,834,687 A * 5/1989 Elam ..... 446/4

* cited by examiner

*Primary Examiner*—Bena Miller

(57) ABSTRACT

A children's educational toy includes a log section having a plurality of uniquely shaped and detachable log portions for defining altering portions of the log section. Each log portion has a top surface provided with a plurality of spaced notches for defining a striking area medially of the plurality of log portions respectively. The assembly further includes a wedge, a wood-splitting maul, and a mechanism for locking the plurality of log portions respectively. The locking mechanism includes a plurality of male portions extending outwardly from select ones of the plurality of sidewalls respectively and a plurality of female portions formed within adjacent ones of the plurality of sidewalls. The plurality of male and female portions are removably engageable when the plurality of sidewalls are positioned adjacent the axis.

15 Claims, 3 Drawing Sheets

STUMP-CUTTING TOY ASSEMBLY

STATEMENT REGARDING FEDERALLY SPONSORED RESEARCH OR DEVELOPMENT

Not Applicable.

CROSS REFERENCE TO RELATED APPLICATIONS

Not Applicable.

REFERENCE TO A MICROFICHE APPENDIX

Not Applicable.

BACKGROUND OF THE INVENTION

1.Technical Field

This invention relates to a child's toy and, more particularly, to a toy that simulates the splitting of a log stump and teaches a child mathematic computations.

2. Prior Art

In customary toys for children, so-called block toys or puzzle games are popular. Such toys are characterized by constructions wherein the blocks have fixed shapes. In other block type toys, articles or structures and the like are constructed and constituted by arranging in a row. Block type toys having previously constructed and constituted articles or structures which were designed to be divided by hand have also been developed.

However, upon reaching adulthood, the previous block type toys provided no real log splitting training or experience. A serious situation can arise wherein an adult cannot master the use of an axe or cannot skillfully use other types of chopping utensils because they have no prior experience as a child. In spite of the fact that an edged tool can be a safe article when properly used, the fact that children are usually kept away or are prohibited from using an edged tool because of a preconception that the edged tool is dangerous simply is a cause for this situation. During operation of this toy, a child's physical abilities are enhanced through actions very similar to those utilized by a person actually splitting a log.

Accordingly, a need remains for a toy that simulates the splitting of a log and teaches children how to operate wood splitting tools safely while improving eye-hand coordination.

BRIEF SUMMARY OF THE INVENTION

In view of the foregoing background, it is therefore an object of the present invention to provide an educational toy apparatus for splitting wood. These and other objects, features, and advantages of the invention are provided by a children's toy for simulating log cutting and including a log section having a centrally disposed longitudinal axis and comprising a plurality of detachable log portions radially juxtaposed about the axis. The plurality of log portions preferably have unique shapes for defining altering portions of the log section. For example, each log portion may define a percentage of a pie wherein the combined log portions equate to 100%. Of course, such percentages may be listed as fractions or decimals.

Each of the plurality of log portions has oppositely engageable sidewalls and cumulatively define a top surface of the log section. The top surface further has a plurality of notches for defining a striking area medially of the plurality of log portions respectively. Each notch is radially spaced from the axis and is disposed generally above the locking mechanism respectively. Of course, such notches may been formed in varying sizes and shapes for assisting children of different skill levels to split the log section.

The assembly further includes a wedge having a substantially pie shape and a lower surface positionable onto the striking area and a wood-splitting maul including a head having a selected surface area for assisting a child to repeatedly contact the wedge and thereby cause select ones of the plurality of log portions to become separated from the log section. The wood-splitting maul preferably includes a long handle with both a flat and a wedge shaped striking surface so that a child may split the log section with or without employing the wedge, for example. The assembly further includes a mechanism for locking the plurality of log portions respectively. The locking mechanism is integral with the plurality of log portions and has a line of weakness defined along the plurality of sidewalls respectively.

The locking mechanism preferably includes a plurality of male portions extending outwardly from select ones of the plurality of sidewalls respectively and a plurality of female portions formed within adjacent ones of the plurality of sidewalls. Advantageously, the plurality of male and female portions are removably engageable when the plurality of sidewalls are positioned adjacent the axis. In one embodiment, the plurality of male and female portions have corresponding shapes for interlocking to each other respectively. In an alternate embodiment, each of the plurality of corresponding male and female portions have a unique shape so that a user must match pairs of the unique shapes to rebuild the log section. By splitting the log portions are reassembling same, a child will learn how to match associated shapes and count with fractions, for example.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
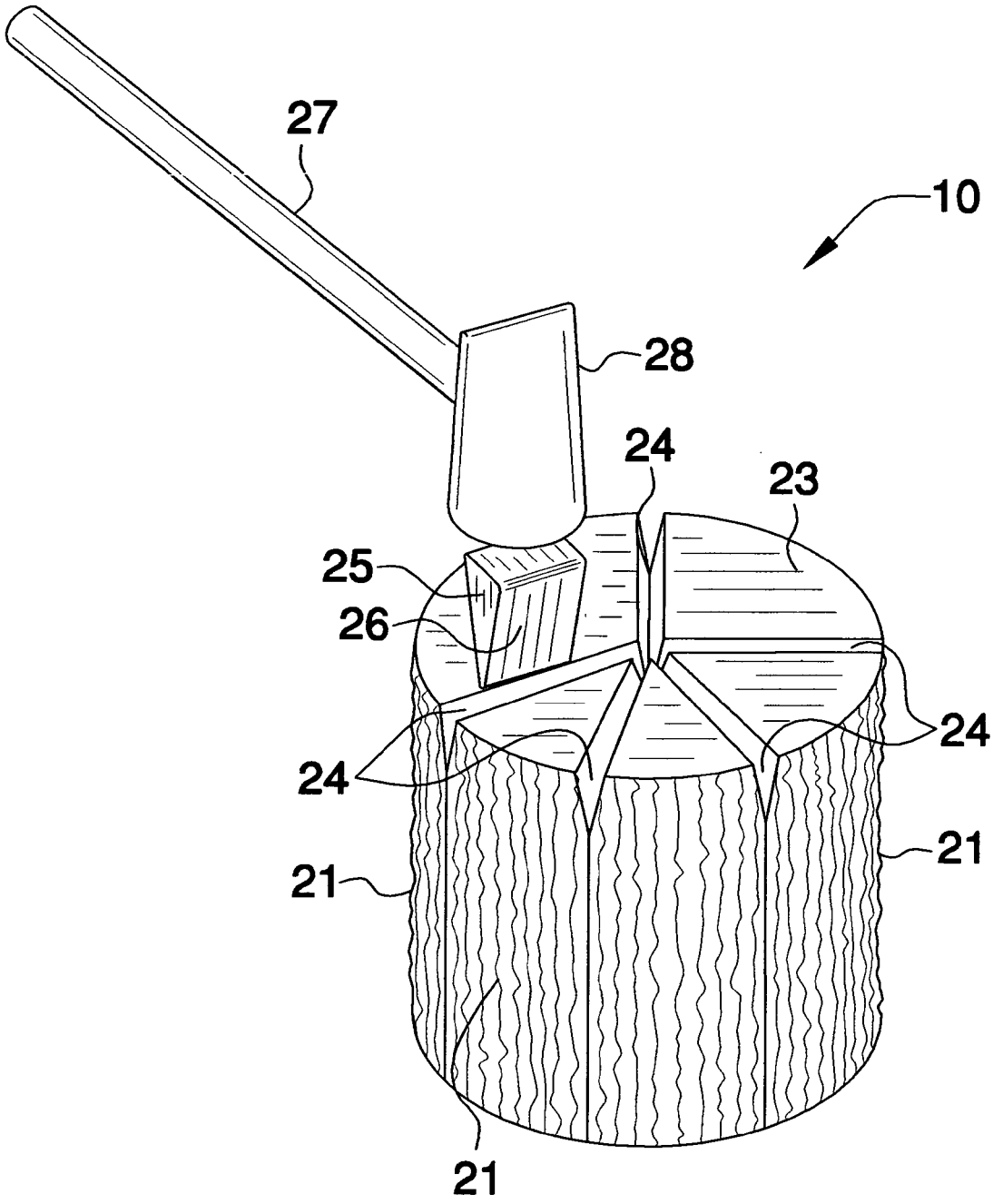
FIG. 1 is a perspective view showing a toy stump-cutting assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide an educational stump-cutting toy assembly. It should be understood that the assembly 10 may be used to simulate the splitting of many different types of objects and should not be limited to only stumps or logs. For example, each log portion may define a percentage of a pie wherein the combined log portions equate to 100%. Of course, such percentages may be listed as fractions or decimals.

Figure 3:
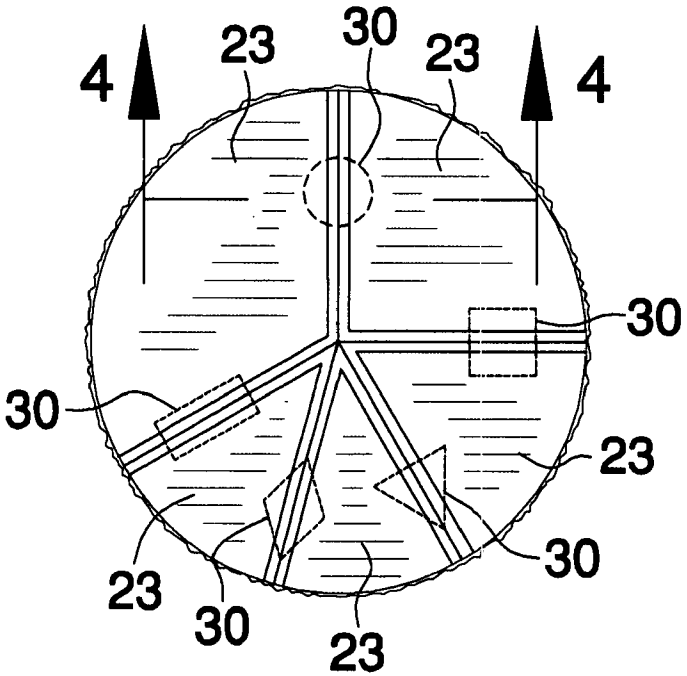
FIG. 3 is a top plan view of the log section illustrating the lines of weakness.

Initially referring to FIG. 1, the assembly 10 includes a log section 20 having a centrally disposed longitudinal axis (not shown) and a plurality of detachable log portions 21 radially juxtaposed about the axis. The plurality of log portions 21 each have unique shapes for defining altering portions of the log section 20. The unique shapes define various sizes portions of the log section 20 that may be split off by a user during operating conditions. Referring to FIGS. 1 and 3, each of the plurality of log portions 21 has oppositely engageable sidewalls 22 that cumulatively define a top surface 23 of the log section 20. The top surface 23 further has a plurality of notches 24 for defining a striking area medially of the plurality of log portions 21 respectively. Such notches 24 may be shaped and sized for accommodating children of varying skill level so that a child make accurately split the log section 20 during initial strikes of the maul 27.

The assembly further includes a wedge 25 having a substantially pie shape and a lower surface 26 positionable onto the striking area and a wood-splitting maul 27 including a head 28 having a selected surface area for assisting a child to repeatedly contact the wedge 25 and thereby cause select ones of the plurality of log portions 21 to become separated from the log section 20. The wedge 25 and wood-splitting maul 27 assist a child in learning how to use wood splitting tools so that when they reach adulthood they will be able to use real tools safely. A conventional maul 27 may be employed wherein a handle is provided with a flat and wedge shaped striking head for assisting a child to split the log section 20 with or without wedge 25.

Figure 2:
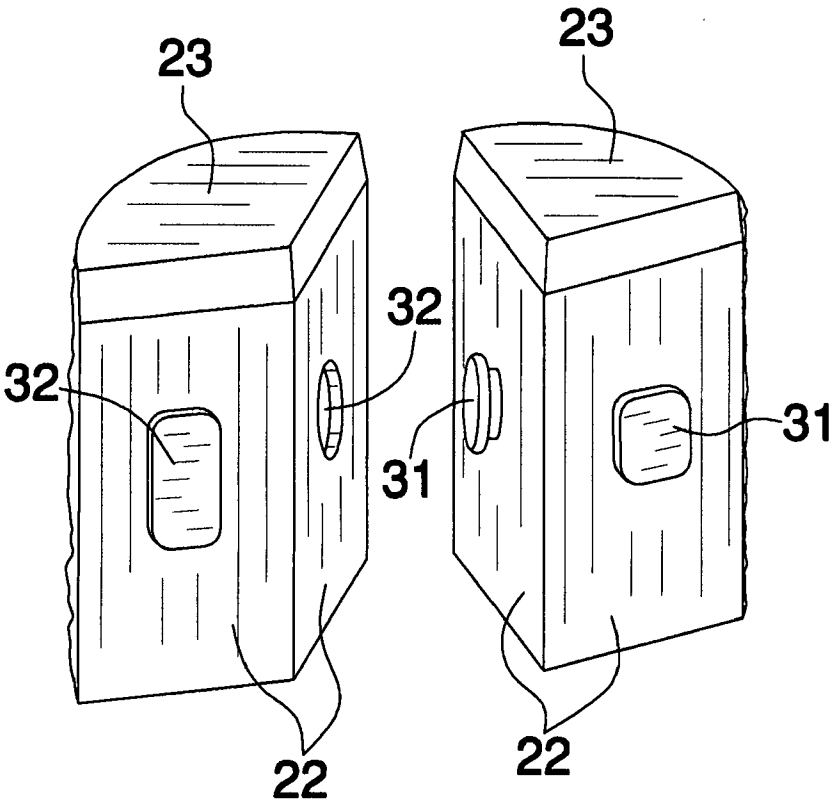
FIG. 2 is a perspective view of a plurality of log portions at a separated position.
Figure 4:
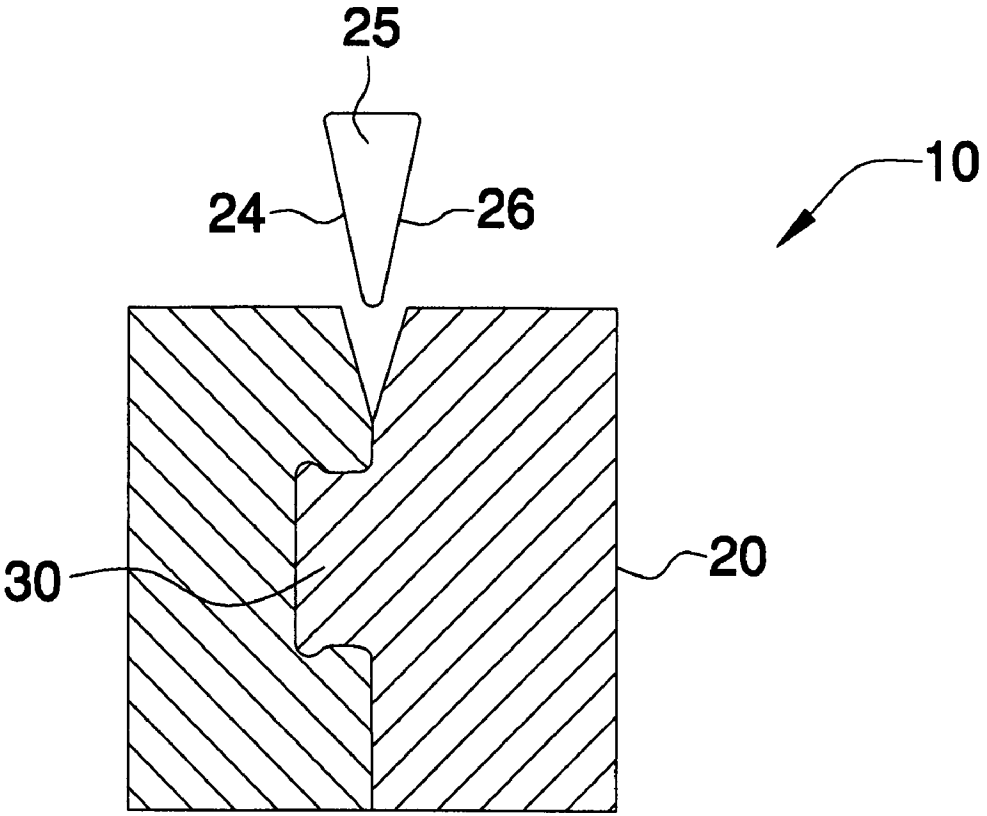
FIG. 4 is a cross-sectional view of the log section showing the locking mechanism, taken along line 4—4.

Now referring to FIGS. 2 and 4, the assembly 10 further includes a mechanism 30 for locking the plurality of log portions 21 respectively. The locking mechanism 30 is integral with the plurality of log portions 21 and has a line of weakness defined along the plurality of sidewalls 22 respectively. Each notch 24 is radially spaced from the axis and is disposed generally above the locking mechanism 30 respectively, as best shown in FIG. 1.

Referring back to FIG. 2, the locking mechanism 30 includes a plurality of male portions 31 extending outwardly from select ones of the plurality of sidewalls 22 respectively and a plurality of female portions 32 formed within adjacent ones of the plurality of sidewalls 22. The plurality of male 31 and female 32 portions are removably engageable when the plurality of sidewalls 22 are positioned adjacent the axis. The plurality of male 31 and female 32 portions have corresponding shapes for interlocking to each other respectively. Each of the plurality of corresponding male 31 and female 32 portions have a unique shape so that a user must match pairs of the unique shapes to rebuild the log section. In this manner a user child learns not only how to split wood, but also how to put it back together and count with fractions, for example. Of course, the plurality of male 31 and female 32 members may have square, triangular, annular or rectangular shapes, for example, as well known to a person of ordinary skill in the art.

Referring back to FIGS. 1–4, the log section 20 has a longitudinal length greater than a diameter of the top surface 23. Notches 24 radially extend from the axis to a perimeter of the log section 20. The male portions 31 are uniquely shaped and include a shaft and a monolithically formed flange portion extending outwardly and orthogonally from a perimeter of the shaft. The female portions 32 include an aperture and a lip portion extending inwardly and orthogonally from a perimeter of the aperture wherein the flange portions removably engage the lip portion of the female portions 32 when the plurality of sidewalls 22 are positioned adjacent the axis.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A children's toy for simulating log cutting, said toy comprising:

a log section having a centrally disposed longitudinal axis and comprising a plurality of detachable log portions radially juxtaposed about the axis, each said plurality of log portions having oppositely engageable sidewalls and cumulatively defining a top surface of said log section, said log section having a longitudinal length greater than the diameter of said top surface, said top surface further having a plurality of notches for defining a striking area medially of said plurality of log portions respectively, the notches radially extending from the axis to a perimeter of said log section;

a wedge having a lower surface positionable onto said striking area;

a wood-splitting maul including a head having a selected surface area for assisting a child to repeatedly contact said wedge and thereby cause select ones of said plurality of log portions to become separated from said log section;

means for locking said plurality of log portions respectively, said locking means being integral with said plurality of log portions and having a line of weakness defined along said plurality of sidewalls respectively;

a plurality of male portions extending outwardly from select ones of said plurality of sidewalls respectively, said male portions being uniquely shaped and each including a shaft and a monolithically formed flange portion extending outwardly and orthogonally from a perimeter of said shaft; and a plurality of female portions formed within adjacent ones of said plurality of sidewalls, said female portions including an aperture and lip portion extending inwardly and orthogonally from a perimeter of the aperture;

wherein said flange portions removably engage said lip portion of said female portions when said plurality of sidewalls are positioned adjacent the axis;

wherein said plurality of male and female portions have corresponding shapes for interlocking to each other respectively, said shapes comprising one of a shape selected from a group of shapes including: an annular shape, a triangular shape, a rectangular shape, a parallelogram shape, and a tetragonal shape.

2. The toy of claim 1, wherein each said plurality of corresponding male and female portions have a unique shape so that a user must match pairs of said unique shapes to rebuild said log section.

3. The toy of claim 1, wherein said wedge has a substantially pie shape.

4. The toy of claim 1, wherein said plurality of log portions having unique shapes for defining altering portions of said log section.

5. The toy of claim 1, wherein each notch is radially spaced from the axis and is disposed generally above said locking means respectively.

6. A children's toy for simulating log cutting, said toy comprising:

a log section sized and shaped to simulate a log stump and having a centrally disposed longitudinal axis, said log section comprising a plurality of detachable log portions radially juxtaposed about the axis, each said plurality of log portions having oppositely engageable sidewalls and cumulatively defining a top surface of said log section, said log section having a longitudinal length greater than the diameter of said top surface, said top surface further having a plurality of notches for defining a striking area medially of said plurality of log portions respectively, the notches radially extending from the axis to a perimeter of said log section, said log section being formed from light-weight material;

a wedge having a lower surface positionable onto said striking area;

a wood-splitting maul including a head having a selected surface area for assisting a child to repeatedly contact said wedge and thereby cause select ones of said plurality of log portions to become separated from said log section; and means for locking said plurality of log portions respectively, said locking means being integral with said plurality of log portions and having a line of weakness defined along said plurality of sidewalls respectively said locking means comprising a plurality of male portions extending outwardly from select ones of said plurality of sidewalls respectively, said male portions being uniquely shaped and each including a shaft and a monolithically formed flange portion extending outwardly and orthogonally from a perimeter of said shaft; and a plurality of female portions formed within adjacent ones of said plurality of sidewalls, said female portions including an aperture and lip portion extending inwardly and orthogonally from a perimeter of the aperture;

wherein said flange portions removably engage said lip portion of said female portions when said plurality of sidewalls are positioned adjacent the axis;

wherein said plurality of male and female portions have corresponding shapes for interlocking to each other respectively, said shapes comprising one shape selected from a group of shapes including: an annular shape, a triangular shape, a rectangular shape, a parallelogram shape, and a tetragonal shape.

7. The toy of claim 6, wherein each said plurality of corresponding male and female portions have a unique shape so that a user must match pairs of said unique shapes to rebuild said log section.

8. The toy of claim 6, wherein said wedge has a substantially pie shape.

9. The toy of claim 6, wherein said plurality of log portions having unique shapes for defining altering portions of said log section.

10. The toy of claim 6, wherein each notch is radially spaced from the axis and is disposed generally above said locking means respectively.

11. A children's toy for simulating log cutting, said toy comprising:

a log section sized and shaped to simulate a log stump and having a centrally disposed longitudinal axis, said log section comprising a plurality of detachable log portions having pie-shapes and being radially juxtaposed about the axis, each said plurality of log portions having oppositely engageable sidewalls and cumulatively defining a top surface of said log section, said log section having a longitudinal length greater than the diameter of said top surface, said top surface further having a plurality of notches for defining a striking area medially of said plurality of log portions respectively, the notches radially extending from the axis to a perimeter of said log section, said log section being formed from light-weight material;

a plastic wedge having a lower surface positionable onto said striking area;

a plastic wood-splitting maul including a head having a selected surface area for assisting a child to repeatedly contact said wedge and thereby cause select ones of said plurality of log portions to become separated from said log section; and means for locking said plurality of log portions respectively, said locking means being integral with said plurality of log portions and having a line of weakness defined along said plurality of sidewalls respectively said locking means comprising a plurality of male portions extending outwardly from select ones of said plurality of sidewalls respectively, said male portions being uniquely shaped and each including a shaft and a monolithically formed flange portion extending outwardly and orthogonally from a perimeter of said shaft; and a plurality of female portions formed within adjacent ones of said plurality of sidewalls, said female portions including an aperture and lip portion extending inwardly and orthogonally from a perimeter of the aperture;

wherein said flange portions removably engage said lip portion of said female portions when said plurality of sidewalls are positioned adjacent the axis;

wherein said plurality of male and female portions have corresponding shapes for interlocking to each other respectively;

wherein each said plurality of corresponding male and female portions have a unique shape so that a user must match pairs of said unique shapes to rebuild said log section, said shapes comprising one shape selected from a group of shapes including: an annular shape, a triangular shape, a rectangular shape, a parallelogram shape, and a tetragonal shape.

12. The toy of claim 11, wherein each said plurality of corresponding male and female portions have a unique shape so that a user must match pairs of said unique shapes to rebuild said log section.

13. The toy of claim 11, wherein said wedge has a substantially pie shape.

14. The toy of claim 11, wherein said plurality of log portions having unique shapes for defining altering portions of said log section.

15. The toy of claim 11, wherein each notch is radially spaced from the axis and is disposed generally above said locking means respectively.

* * * * *